US007735609B2

(12) United States Patent
Ito et al.

(10) Patent No.: US 7,735,609 B2
(45) Date of Patent: Jun. 15, 2010

(54) CONTROLLER OF INDUSTRIAL VEHICLE, INDUSTRIAL VEHICLE, AND CONTROL METHOD FOR INDUSTRIAL VEHICLE

(75) Inventors: Yoshiharu Ito, Kariya (JP); Tadashi Yamada, Kariya (JP); Hidenori Oka, Kariya (JP); Toshikazu Kamiya, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 841 days.

(21) Appl. No.: 11/437,361

(22) Filed: May 19, 2006

(65) Prior Publication Data

US 2006/0260877 A1 Nov. 23, 2006

(30) Foreign Application Priority Data

May 20, 2005 (JP) ..... 2005-147472

(51) Int. Cl.
*B66B 1/00* (2006.01)

(52) U.S. Cl. ..... 187/277; 187/224; 187/276

(58) Field of Classification Search ..... 187/224, 187/276, 277

See application file for complete search history.

(56) References Cited

U.S. PATENT DOCUMENTS

| | | | | |
|---|---|---|---|---|
| 5,050,379 | A | 9/1991 | Nagai et al. | 60/368 |
| 6,179,304 | B1 | 1/2001 | Ishikawa et al. | |
| 6,296,081 | B1 * | 10/2001 | Nagai et al. | 187/394 |
| 6,350,100 | B1 * | 2/2002 | Naruse et al. | 414/635 |
| 6,425,728 | B1 * | 7/2002 | Goto | 414/636 |
| 7,069,722 | B2 * | 7/2006 | Lonn | 60/430 |
| 7,287,625 | B1 * | 10/2007 | Harris | 187/282 |
| 2001/0030085 | A1 * | 10/2001 | Nagata et al. | 187/222 |

FOREIGN PATENT DOCUMENTS

| | | |
|---|---|---|
| JP | 2004-011469 | 1/2004 |
| JP | 2004-359414 | 12/2004 |
| TW | 442409 B | 6/2001 |
| TW | 494084 B | 7/2002 |
| WO | WO 99/16698 | 4/1999 |
| WO | WO 01/66977 | 9/2001 |

OTHER PUBLICATIONS

European Search Report from counterpart application (dated Oct. 5, 2006).
Taiwanese Office Action dated Dec. 4, 1996, received in Taiwanese Patent Application No. 095117778 without English translation.
European Search Report dated Sep. 19, 2000 issued by European Patent Office for application No. PCT/JP00/03887.

* cited by examiner

*Primary Examiner*—Walter Benson
*Assistant Examiner*—Kawing Chan
(74) *Attorney, Agent, or Firm*—Locke Lord Bissell & Liddell, LLP

(57) ABSTRACT

A traveling operation detecting portion detects traveling operation and non-traveling operation selectively. The traveling operation corresponds to operator operation that involves traveling of an industrial vehicle. The non-traveling operation corresponds to operator operation that does not involve the traveling of the industrial vehicle. An upper setting portion selectively sets a first engine speed upper limit and a second engine speed upper limit, which are different from each other, as an upper limit of an acceptable speed range of an engine in correspondence with a detection result of the traveling operation detecting portion. Thus, maximum advantage of the performance of the engine is ensured in correspondence with operation of the industrial vehicle.

10 Claims, 8 Drawing Sheets

CONTROLLER OF INDUSTRIAL VEHICLE, INDUSTRIAL VEHICLE, AND CONTROL METHOD FOR INDUSTRIAL VEHICLE

BACKGROUND OF THE INVENTION

The present invention relates to a controller of an industrial vehicle, an industrial vehicle, and a control method for an industrial vehicle.

In some conventional industrial vehicles, such as loading vehicles, an engine drives a traveling mechanism and mechanisms (including a loading actuator) other than the traveling mechanism, which causes the industrial vehicle to travel (see, for example, Japanese Laid-Open Patent Publication Nos. 2004-11469 and 2004-359414).

In an industrial vehicle and a control method for the industrial vehicle described in Japanese Laid-Open Patent Publication No. 2004-11469, the engine speed is controlled in correspondence with the operational state of the industrial vehicle. Specifically, such controlling is performed with reference to different information including the operation amount of a loading lever, the depression amount of an accelerator pedal, and the depression amount of a clutch pedal. This suppresses gunning of the engine that generates noise, while simplifying the configuration of the industrial vehicle.

In an industrial vehicle and a controller of an industrial vehicle described in Japanese Laid-Open Patent Publication No. 2004-359414, it is determined that the industrial vehicle is in a process of loading if a vehicle speed detecting portion detects that the vehicle speed is zero. In this case, the controller operates to maximize the shaft torque of the engine. This ensures the engine torque needed for loading of the industrial vehicle even in a dark environment, although the speed of the industrial vehicle is limited in correspondence with the amount of light in the environment.

However, in the industrial vehicle and the control method for the industrial vehicle of Japanese Laid-Open Patent Publication No. 2004-11469, controlling of the engine speed for suppressing the gunning of the engine is performed in correspondence with a priority selected from the operational state of the loading lever, that of the accelerator pedal, and that of the clutch pedal. In other words, such controlling is performed only in a range up to an upper limit of the engine speed that is determined by the traveling performance of the industrial vehicle and in correspondence with the operational state of the loading lever or the accelerator pedal or the clutch pedal. Accordingly, the control method and the industrial vehicle do not sufficiently satisfy a requirement that the engine should be controlled in such a manner as to ensure maximum advantage of the engine performance in correspondence with the operational state of the industrial vehicle.

Further, in the industrial vehicle and the controller for the industrial vehicle described in Japanese Laid-Open Patent Publication No. 2004-359414, in which the engine torque necessary for loading in the dark environment is ensured, determination that the industrial vehicle is in a loading process depends solely on detection that the vehicle speed is zero. Therefore, efficient controlling of the engine is limited to the operational state (condition) of the industrial vehicle in which the vehicle speed is zero. Accordingly, like the control method and the industrial vehicle of Japanese Laid-Open Patent Publication No. 2004-11469, the controller and the industrial vehicle of this document do not sufficiently satisfy the above-described requirement.

SUMMARY OF THE INVENTION

Accordingly, it is an objective of the present invention to provide a controller of an industrial vehicle, an industrial vehicle, and a control method for an industrial vehicle that improve the operational efficiency of the industrial vehicle by controlling an engine in such a manner as to ensure maximum advantage of the engine performance in correspondence with the operational state of the industrial vehicle.

To achieve the foregoing and other objectives and in accordance with the purpose of the present invention, the invention provides a controller provided in an industrial vehicle driven by an engine. The controller includes a traveling operation detection portion and an upper limit setting portion. The traveling operation detecting portion detects traveling operation and non-traveling operation selectively. The traveling operation corresponds to operation by an operator with an intention of driving the industrial vehicle. The non-traveling operation corresponds to operation by the operator without an intention of driving the industrial vehicle. The upper limit setting portion selectively sets, as an upper limit of an acceptable speed range of the engine, a first engine speed upper limit and a second engine speed upper limit different from the first engine speed upper limit in correspondence with a detection result of the traveling operation detecting portion. The first engine speed upper limit corresponds to the traveling operation, and the second engine speed upper limit corresponds to the non-traveling operation.

Also, the present invention provides an industrial vehicle that is driven by an engine and includes a traveling operation detecting portion and an upper limit setting portion. The traveling operation detecting portion detects traveling operation and non-traveling operation selectively. The traveling operation corresponds to operation by an operator with an intention of driving the industrial vehicle. The non-traveling operation corresponds to operation by the operator without an intention of driving the industrial vehicle. The upper limit setting portion selectively sets, as an upper limit of an acceptable speed range of the engine, a first engine speed upper limit and a second engine speed upper limit different from the first engine speed upper limit in correspondence with a detection result of the traveling operation detecting portion. The first engine speed upper limit corresponds to the traveling operation, and the second engine speed upper limit corresponds to the non-traveling operation.

Further, the invention provides a method for controlling operation of an industrial vehicle driven by an engine. The method includes a traveling operation detecting step and an upper limit setting step. In the traveling operation detecting step, traveling operation or non-traveling operation is detected. The traveling operation corresponds to operation by an operator with an intention of driving the industrial vehicle. The non-traveling operation corresponds to operation by the operator without an intention of driving the industrial vehicle. In the upper limit setting step, as an upper limit of an acceptable speed range of the engine, a first engine speed upper limit and a second engine speed upper limit different from the first engine speed upper limit is selectively set in correspondence with a detection result from the traveling operation detecting step. The first engine speed upper limit corresponds to the traveling operation, and the second engine speed upper limit corresponds to the non-traveling operation.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

The best mode for carrying out the present invention will now be described with reference to the attached drawings.

Figure 1:
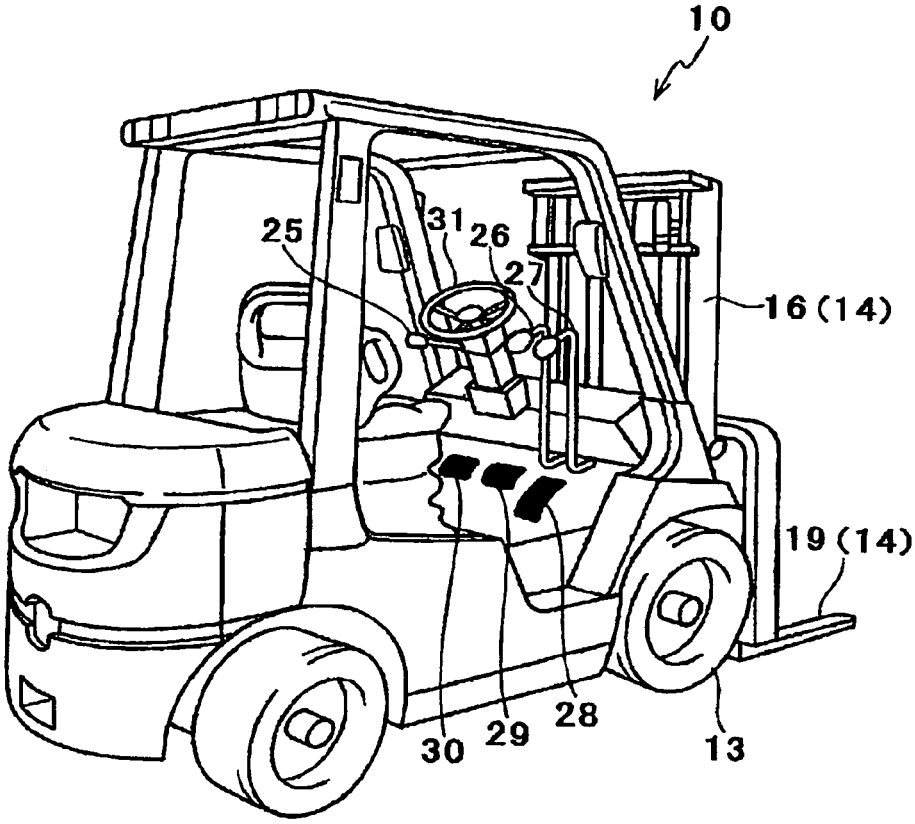
FIG. 1 is a perspective view showing a forklift as an industrial vehicle according to a first embodiment of the present invention.
Figure 2:
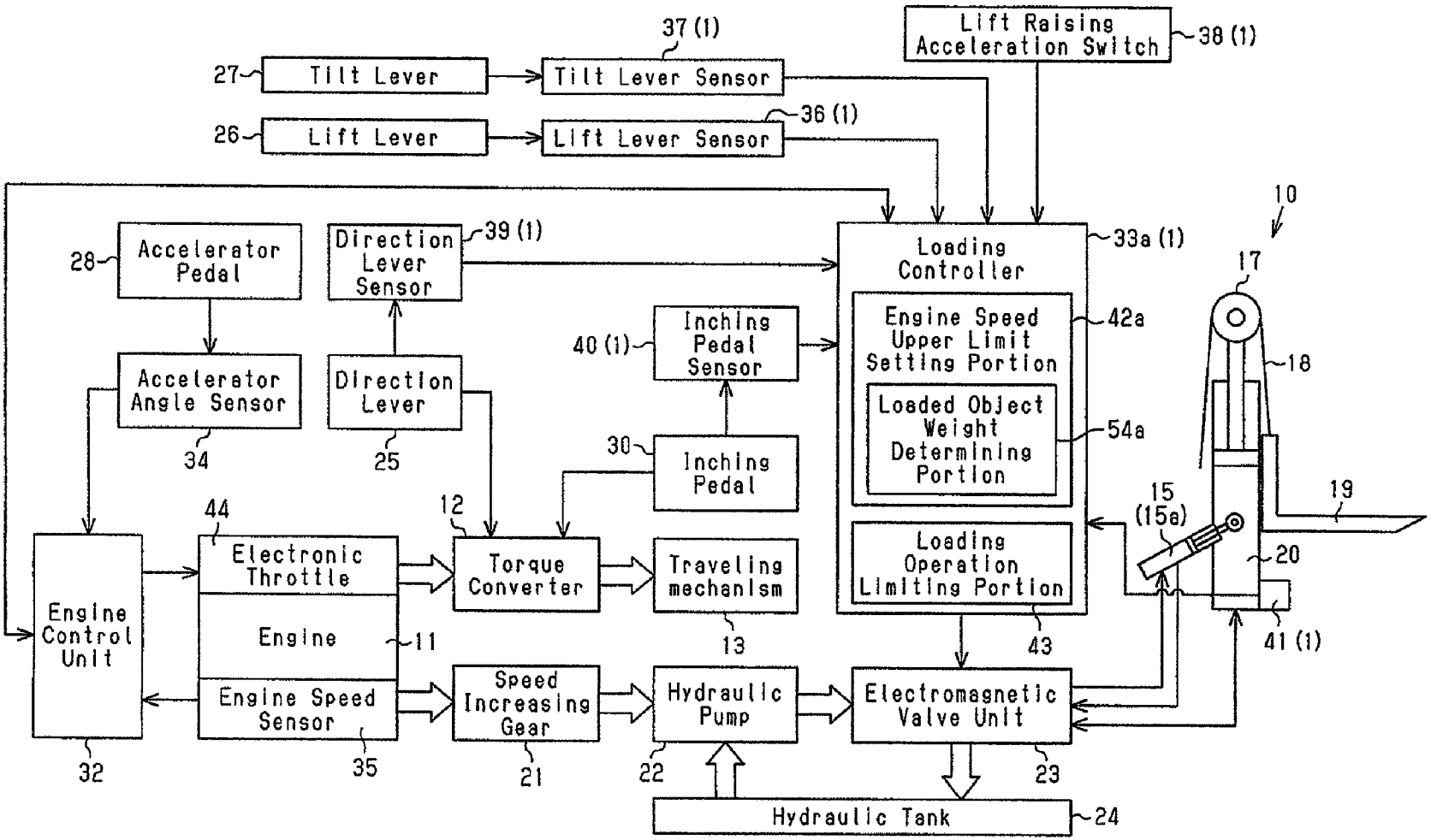
FIG. 2 is a diagram representing the configuration of a controller of the industrial vehicle of FIG. 1, including a portion of the industrial vehicle.

First, an industrial vehicle according to a first embodiment of the present invention will be explained schematically. FIG. 1 is a perspective view showing a forklift 10, which is an example of the industrial vehicle of the first embodiment, as viewed from diagonally behind. FIG. 2 is a diagram representing a first controller 1 of the forklift 10 (a controller of the industrial vehicle of the first embodiment), including the configuration of a portion of the forklift 10.

As shown in FIGS. 1 and 2, the forklift 10 includes an engine 11, a torque converter 12, a traveling mechanism 13. The engine 11 drives the traveling mechanism 13 through the torque converter 12, which is a power transmission mechanism. In other words, the forklift 10 is configured as a torque-converter type, front-wheel-drive and rear-wheel-steering four-wheel vehicle.

Referring to FIGS. 1 and 2, the forklift 10 also has a lift device 14, or a first loading actuator, and a tilt device 15, or a second loading actuator. The lift device 14 selectively raises and lowers an object (not shown) carried by the forklift 10. The tilt device 15 tilts the lift device 14 selectively in a forward direction and a rearward direction. In the first embodiment, the traveling mechanism 13 functions as a first mechanism, while the lift device 14 and the tilt device 15 function as a second mechanism. The tilt device 15 includes a tilt cylinder 15*a* and corresponds to a loading actuator provided in addition to the lift device 14.

The lift device 14 has a pair of lateral outer masts 16 and an inner mast (not shown), which is arranged between the outer masts 16. The inner mast is selectively raised and lowered. A fork 19 is suspended from an upper portion of the inner mast by a chain 18, which is wound around a sprocket 17. In this state, the fork 19 is selectively raised and lowered. Each of the outer masts 16 is connected to the body frame of the forklift 10 through a tilt cylinder 15*a*, which tilts the outer masts 16. The fork 19 is operated through vertical movement of the inner mast, which is caused by actuation of a lift cylinder 20 of the lift device 14.

The lift cylinder 20 and the tilt cylinder 15*a* are actuated by the hydraulic fluid supplied from and returned to a hydraulic pump 22, which is driven by the engine 11. In other words, as illustrated in FIG. 2, the engine 11 drives the traveling mechanism 13 through the torque converter 12 and the hydraulic pump 22 through a speed increasing gear 21. Specifically, the hydraulic fluid is supplied from a hydraulic tank 24 to the hydraulic pump 22. The pressure of the hydraulic fluid is increased by the hydraulic pump 22. The hydraulic fluid is then fed to the lift cylinder 20 and the tilt cylinder 15*a* through a prescribed electromagnetic valve provided in an electromagnetic valve unit 23 including a plurality of electromagnetic valves. The lift cylinder 20 or the tilt cylinder 15*a* thus operates to raise the fork 19 or tilt the fork 19 forward. Further, to operate the lift cylinder 20 or the tilt cylinder 15*a* to lower the fork 19 or tilt the fork 19 rearward, the hydraulic fluid is returned to the hydraulic tank 24 through a prescribed electromagnetic valve of the electromagnetic valve unit 23.

Referring to FIG. 1, the forklift 10 also includes a direction lever 25, a lift lever 26, a tilt lever 27, an accelerator pedal 28, a brake pedal 29, an inching pedal 30, and a steering wheel 31. These components are arranged at positions facing the operator (the driver) of the forklift 10.

The direction lever 25 forms an operating portion that is switched among a proceed position at which the forklift 10 is caused to proceed, a reverse position at which the forklift 10 is caused to reverse, and a neutral position. When the direction lever 25 is set at the neutral position, the engine power is not transmitted to a traveling mechanism 13 of the forklift 10. The lift lever 26 functions as an operating portion by which the lift device 14 is operated to selectively raise and lower the fork 19. The tilt lever 27 forms an operating portion by which the tilt device 15 is operated to tilt the outer masts 16 forward or rearward. In the first embodiment, the tilt lever 27 corresponds to a loading operating portion by which the second loading actuator is operated. The accelerator pedal 28 is operated to alter the traveling speed of the forklift 10. The brake pedal 29 is operated to apply braking force to the forklift 10 when the forklift 10 is traveling. The inching pedal 30 is operated to adjust the connection state between the engine 11 and the traveling mechanism 13 through the torque converter 12 or disconnect the engine 11 and the traveling mechanism 13 from each other.

With reference to FIG. 2, the forklift 10 includes an engine control unit 32 and a first loading controller 33*a*. The first loading controller 33*a* controls operation of the loading actuators (the lift device 14 and the tilt device 15) by controlling actuation of the electromagnetic valves of the electromagnetic valve unit 23. An accelerator angle sensor 34 detects the amount of operation (depression) of the accelerator pedal 28 by the operator of the forklift 10. The engine control unit 32 adjusts the opening degree of an electronic throttle 44 of the engine 11 in correspondence with a detection result of the accelerator angle sensor 34, thus controlling the speed of the engine 11. Accordingly, the forklift 10 travels at a speed corresponding to the operation amount of the accelerator pedal 28. An engine speed sensor 35 is arranged in the engine 11 for detecting the speed of the engine 11. The engine control unit 32 receives an engine speed detection signal from the engine speed sensor 35 and performs feed-back controlling in accordance with the signal.

The first controller 1 according to the first embodiment of the present invention is installed in the forklift 10 and includes a traveling operation detecting portion, the first loading controller 33*a*, a lift lever sensor 36, a tilt lever sensor 37, a lift raising acceleration switch 38, and a weight sensor 41.

The traveling operation detecting portion determines whether the forklift 10 operates in accordance with traveling operation or non-traveling operation. The traveling operation corresponds to a state in which the operator operates the forklift 10 with an intention of driving the forklift 10. The non-traveling operation corresponds to a state in which the operator operates the forklift 10 without an intention of driving the forklift 10. In the first embodiment, the traveling operation detecting portion is formed by a direction lever sensor 39 and an inching pedal sensor 40.

The direction lever sensor 39 functions as a lever position detecting portion that detects the position of the direction lever 25 (the proceed position or the reverse position or the neutral position). The direction lever sensor 39 is connected to the first loading controller 33*a*. The direction lever sensor 39 generates a position detection signal and sends the signal to the first loading controller 33*a*. The torque converter 12 thus operates in accordance with the operation of the direction lever 25.

The inching pedal sensor 40 forms an inching pedal operation detecting portion that detects the operational state (the depression state) of the inching pedal 30. The inching pedal sensor 40 is connected to the first loading controller 33*a*. The inching pedal sensor 40 generates a detection signal and sends the signal to the first loading controller 33*a*. The torque converter 12 thus operates in accordance with the depression of the inching pedal 30.

The lift lever sensor 36 functions as a lift operation detecting portion that detects that the lift lever 26, or a lift operating portion by which the lift device 14 is operated, is being operated. The lift lever sensor 36 is connected to the first loading controller 33*a*. The lift lever sensor 36 generates a lift operation detection signal and sends the signal to the first loading controller 33*a*.

The tilt lever sensor 37 forms a loading operation detecting portion that detects that the tilt lever 27 (a loading operating portion for operating the tilt device 15, which is the second loading actuator) is being operated. The tilt lever sensor 37 is connected to the first loading controller 33*a*. The tilt lever sensor 37 generates a tilt operation detection signal to the first loading controller 33*a*.

The lift raising acceleration switch 38 is depressed by the operator of the forklift 10 to accelerate the lift speed of the fork 19. In other words, the lift raising acceleration switch 38 functions as a switch for acknowledging that the operator of the forklift 10 intends to accelerate the rising speed of the fork 19. In the first embodiment, the lift raising acceleration switch 38 functions as a lift acceleration switch by which the operational mode of the lift device 14 is switched to an acceleration mode.

The first loading controller 33*a* includes a non-illustrated CPU (Central Processing Unit) and memories such as a ROM (Read Only Memory) and a RAM (Random Access Memory). The memories store different types of software including a program for controlling operation of the loading actuators (the lift device 14 and the tilt device 15) by controlling actuation of the electromagnetic valves of the electromagnetic valve unit 23. By combining the hardware and the software, an upper limit setting portion 42*a* and a loading operation limiting portion (a loading operation limiter) 43 are formed in the first loading controller 33*a*.

There are two engine speed upper limits set by the upper limit setting portion 42*a* as an upper limit of the speed of the engine 11 (a maximum engine speed), which defines an upper limit of an acceptable speed range of the engine 11. In this manner, depending on whether the state detected by the traveling operation detecting portion (39, 40) corresponds to the traveling operation or the non-traveling operation, two different values can be set as the engine speed upper limit. In other words, the upper limit setting portion 42*a* sets a traveling engine speed upper limit (hereinafter, a first engine speed upper limit) corresponding to the traveling operation and a non-traveling engine speed upper limit (hereinafter, a second engine speed upper limit) corresponding to the non-traveling operation. The first engine speed upper limit is formed as the upper limit of the speed of the engine 11 that is determined in accordance with the traveling performance of the forklift 10. The second engine speed upper limit is formed as the upper limit of the speed of the engine 11 that is determined in accordance with the performance of the lift device 14, regardless of the traveling performance of the forklift 10. The second engine speed upper limit is higher than the first engine speed upper limit.

The upper limit setting portion 42*a* determines that the forklift 10 is in the non-traveling operation, which does not involve traveling of the forklift 10, at least if the direction lever sensor 39 detects that the direction lever 25 is set at the neutral position or if the inching pedal sensor 40 has detected that the inching pedal 30 is in an operated state. If the non-traveling operation is detected through at least one of the direction lever sensor 39 and the inching pedal sensor 40 and the lift lever sensor 36 has detected that the lift lever 26 is being operated (if condition 1 is satisfied), the upper limit setting portion 42*a* is permitted to set the second engine speed upper limit. Further, if the non-traveling operation is detected and the lift raising acceleration switch 38 is manipulated (if condition 2 is satisfied), the upper limit setting portion 42*a* is permitted to set the second engine speed upper limit. That is, if at least one of conditions 1, 2 is satisfied and the tilt lever sensor 37 detects that the tilt lever 27 is in a non-operated state, the upper limit setting portion 42*a* is permitted to set the second engine speed upper limit.

If the tilt lever 27 (the loading operating portion for operating the tilt device 15, or the second loading actuator) is operated under the second engine speed upper limit, which has been set by the upper limit setting portion 42*a*, the loading operation limiting portion 43 of the first loading controller 33*a* controls actuation of a prescribed electromagnetic valve of the electromagnetic valve unit 23 to prohibit operation of the tilt device 15, regardless of operation of the tilt lever 27. Further, once the lift device 14 is switched to a lift accelerating state, the loading operation limiting portion 43 prohibits the operation of the tilt device 15 (the second loading actuator) until the lift device 14 is released from the lift accelerating state.

The weight sensor 41 detects the weight of the object carried by the forklift 10. The weight sensor 41 is secured to, for example, the bottom of the lift cylinder 20. The weight sensor 41 functions as a pressure sensor that detects the hydraulic pressure in the lift cylinder 20, which varies proportionally to the weight of the object mounted on the fork 19 (the load of the carried object). In other words, the weight sensor 41 indirectly detects the weight of the carried object. The upper limit setting portion 42*a* includes a weight determining portion 54*a* that determines whether the weight of the carried object, which is detected by the weight sensor 41, is smaller than or equal to a predetermined threshold value. If the weight of the carried object is smaller than or equal to the threshold value, the upper limit setting portion 42*a* sets the second engine speed upper limit. If the weight of the carried object is greater than the threshold value, the upper limit setting portion 42*a* maintains the first engine speed upper limit.

After the first loading controller 33*a* sets the first engine speed upper limit or the second engine speed upper limit, as has been described, the set engine speed is output to the engine control unit 32. The engine control unit 32 adjusts the opening degree of the electronic throttle 44 in a range corresponding to an engine speed range having an upper limit corresponding to the set value and in correspondence with an input from the accelerator angle sensor 34. The speed of the engine 11 is thus controlled.

Operation of the first controller 1, or a control method for an industrial vehicle according to the first embodiment of the present invention (a control method according to the first embodiment), will hereafter be explained with reference to the flowcharts of FIGS. 3 to 5. The first controller 1 operates in accordance with the procedure of FIG. 3. The procedure is carried out in association with a predetermined main procedure that is periodically performed by the first loading controller 33*a*. Therefore, the procedure of FIG. 3 is repeatedly performed every time the main procedure is repeatedly executed.

Figure 3:
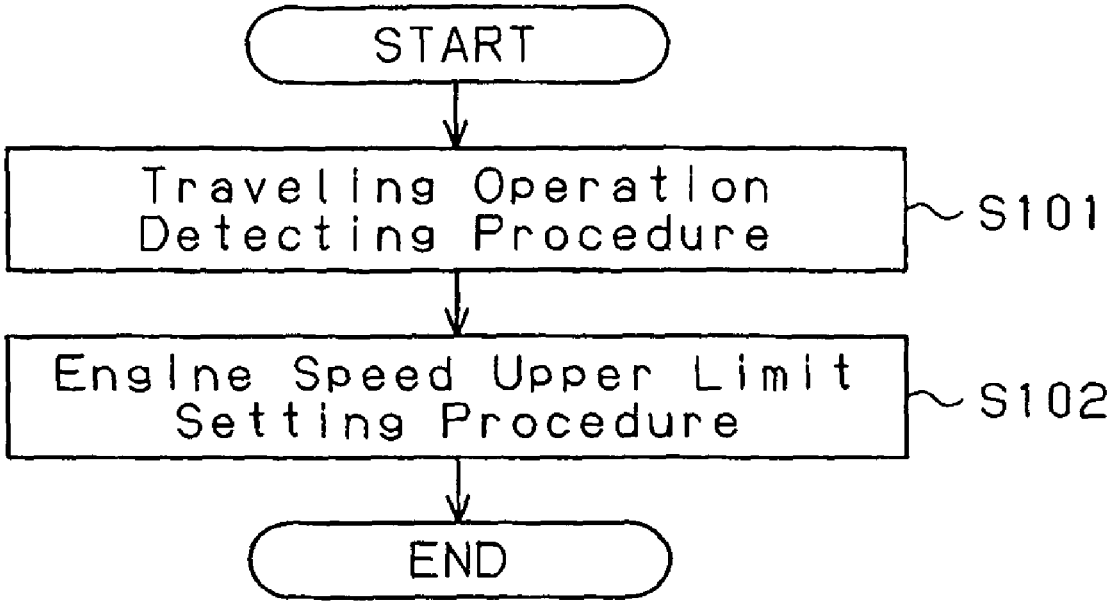
FIG. 3 is a flowchart representing a control procedure executed by the controller of FIG. 2.

To start the procedure of FIG. 3 (operation of the first controller 1), a traveling operation detecting procedure is performed in step S101. An engine speed upper limit setting procedure is then performed in step S102. This ends a first cycle (a first loop) of the procedure of FIG. 3. In other words, the control method by the first controller 1 according to the first embodiment includes a traveling operation detecting step corresponding to the traveling operation detecting procedure of step S101 and an engine speed upper limit setting step corresponding to the engine speed upper limit setting procedure of step S102.

Figure 4:
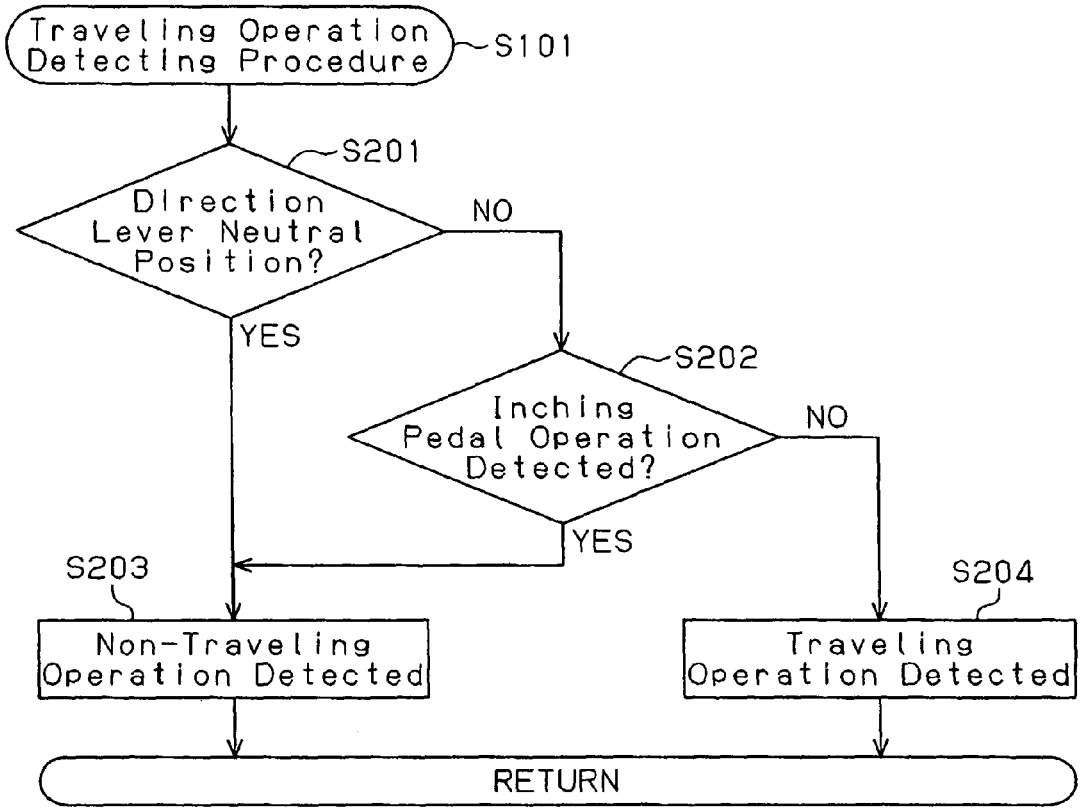
FIG. 4 is a flowchart representing a traveling operation detecting procedure of FIG. 3.

More specifically, as the traveling operation detecting procedure (step S101), the procedure of FIG. 4 is executed so that the first loading controller 33*a* detects the traveling operation or the non-traveling operation. The procedure corresponding to the flowchart of FIG. 4 represents an example of the traveling operation detecting procedure (step S101). In the procedure of FIG. 4, it is first determined whether the direction lever sensor 39 has detected that the direction lever 25 is held at the neutral position (in step S201). If the direction lever sensor 39 has detected that the direction lever 25 is set at the neutral position (YES in step S201), the non-traveling operation is detected (in step S203). Contrastingly, if the direction lever sensor 39 has not detected that the direction lever 25 is held at the neutral position state of the direction lever 25 (NO in step S201), step S202 is carried out. In step S202, it is determined whether the inching pedal sensor 40 has detected that the inching pedal 30 has been operated. If the operation of the inching pedal 30 has been detected (YES in step S202), the non-traveling operation is detected. If the operation of the inching pedal 30 has not been detected (NO in step S202), it is determined that the direction lever 25 has not been switched to the neutral position and the inching pedal 30 has not been operated. This indicates that the forklift 10 is in the traveling operation corresponding to the operator operation that involves the traveling of the forklift 10. After the traveling operation or the non-traveling operation has been detected, the traveling operation detecting procedure of FIG. 4 (step S101) is ended. The procedure of FIG. 3 is thus repeated.

Subsequently, referring to FIG. 3, the engine speed upper limit setting procedure of step S102 is executed. As this procedure, the procedure of FIG. 5 is carried out so that the first loading controller 33*a* sets the first engine speed upper limit or the second engine speed upper limit. The procedure corresponding to the flowchart of FIG. 5 represents an example of the engine speed upper limit setting procedure of step S102.

Figure 5:
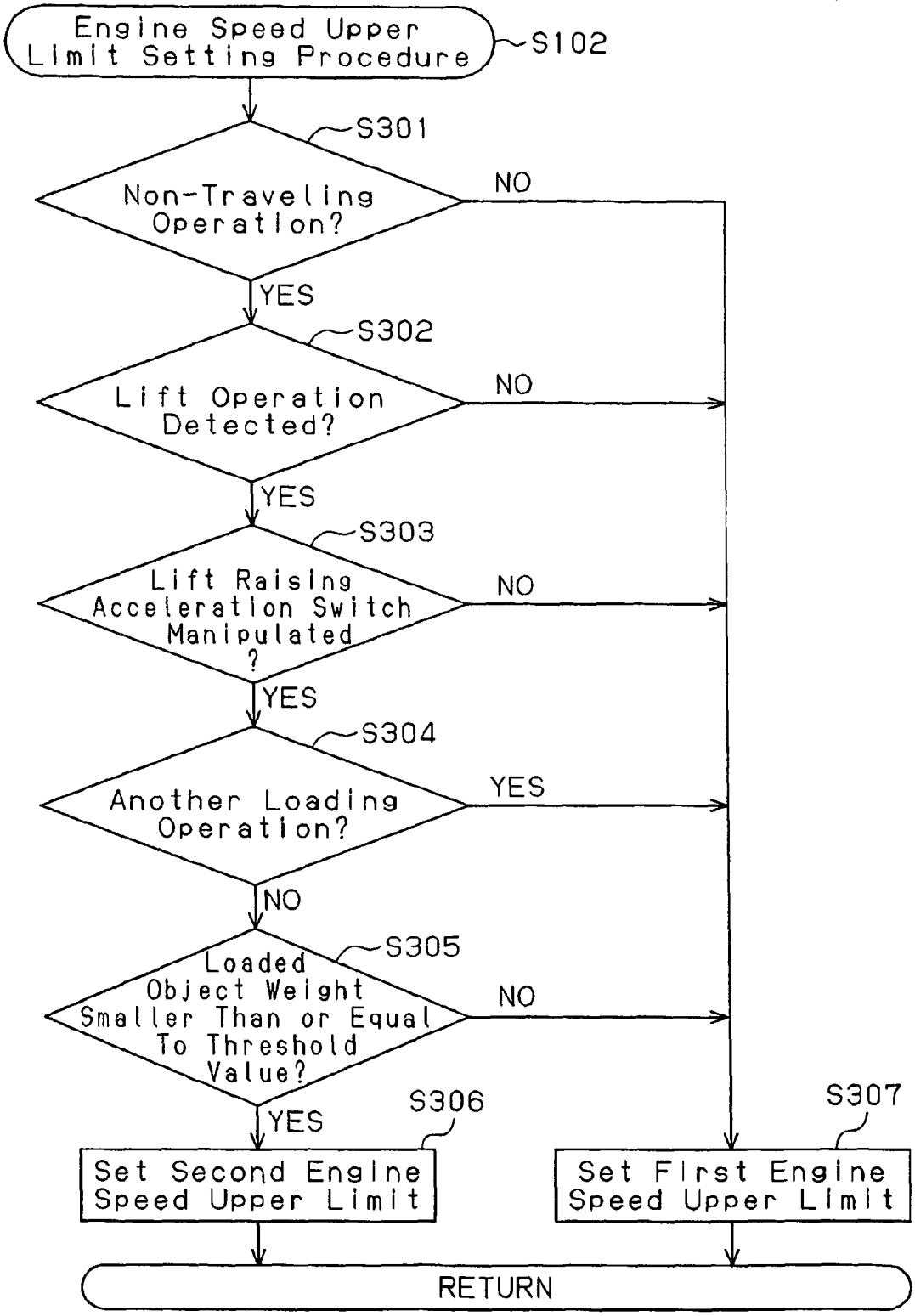
FIG. 5 is a flowchart representing an engine speed upper limit setting procedure of FIG. 3.

In the procedure of FIG. 5, it is first determined whether the forklift 10 is in the non-traveling operation (in step S301). If it is determined that the forklift 10 is not in the non-traveling operation (NO in step S301), or the forklift 10 is in the traveling operation, the first engine speed upper limit is set (in step S307). Contrastingly, if it is determined that the forklift 10 is in the non-traveling operation (YES in step S301), it is determined whether the lift lever sensor 36 has detected that the lift lever 26 is being operated (in step S302). Such detection of the operated state of the lift lever 26 by the first controller 1 corresponds to a lift operation detecting step of the control method according to the first embodiment.

If the operation of the lift lever 26 has not been detected (NO in step S302), the first engine speed upper limit is set (in step S307). Contrastingly, if the operation of the lift lever 26 has been detected (YES in step S302), it is determined whether the lift raising acceleration switch 38 has been manipulated (in step S303). Such detection of manipulation of the lift raising acceleration switch 38 by the first controller 1 corresponds to a switch manipulation detecting step of the control method according to the first embodiment.

If it is determined that the lift raising acceleration switch 38 has not been manipulated in step S303 (NO in step S303), the first engine speed upper limit is set (in step S307). If it is determined that the lift raising acceleration switch 38 has been manipulated in step S303 (YES in step S303), it is determined whether the tilt lever sensor 37 has detected that the tilt lever 27 is being operated (in step S304).

If the operation of the tilt lever 27 has not been detected (NO in step S304), it is determined whether the weight of the carried object is smaller than or equal to the predetermined threshold value (in step S305). Contrastingly, if the operation of the tilt lever 27 has been detected (YES in step S304), the first engine speed upper limit is set (in step S307). If the weight of the carried object is determined to be smaller than or equal to the threshold value (YES in step S305), the second engine speed upper limit is set (in step S306). If the weight of the carried object is determined to be greater than the threshold value (NO in step S305), the first engine speed upper limit is set (in step S307). After the first or second engine speed upper limit is set, the engine speed upper limit setting procedure of step S102 is ended. The procedure of FIG. 3 is then repeated.

The engine speed upper limit set in the procedure of FIG. 3, which is either the first engine speed upper limit or the second engine speed upper limit, is provided to the engine control unit 32. Thus, as has been described, the speed of the engine 11 is controlled in the range having the upper limit that corresponds to the set engine speed upper limit.

Accordingly, the first controller 1 and the control method performed by the first controller 1 have the following advantages.

(1-1) When the traveling operation detecting portion (39, 40) detects the non-traveling operation, it is indicated that the speed of the engine 11 can be changed without influencing traveling of the forklift 10. This allows the upper limit setting portion 42*a* of the first loading controller 33*a* to set the second engine speed upper limit, which is different from the first engine speed upper limit. The operation of the forklift 10 is thus controlled in correspondence with the operational state of the forklift 10 while ensuring maximum advantage of the performance of the engine 11. This improves the operational efficiency of the forklift 10. In other words, the first controller 1 that operates in accordance with the control method of the first embodiment ensures maximum advantage of the performance of the engine 11 corresponding to the operational state of the forklift 10, which is either the state corresponding to the traveling operation or the state corresponding to the non-traveling operation. In the traveling operation, the engine 11 drives the traveling mechanism 13. In the non-traveling operation, the traveling mechanism 13 is disconnected from the engine 11, while the second loading actuator (the tilt device 15) is driven by the engine 11.

(1-2) When the forklift 10 is in the non-traveling operation (in which traveling of the forklift 10 is not influenced by the speed of the engine 11) and the lift device 14 (the lift lever 26) is in the operated state, the upper limit of the speed of the engine 11 can be set by the first controller 1 in accordance with the control method of the first embodiment in such a manner as to ensure the maximum advantage of the performance of the engine 11. That is, the operational speed of the lift device 14 is increased and the operational efficiency of the forklift 10 is further improved.

(1-3) When the forklift 10 is in the non-traveling operation (in which traveling of the forklift 10 is not influenced by the speed of the engine 11) and the lift raising acceleration switch 38 is in a manipulated state, the upper limit of the speed of the engine 11 can be set by the first controller 1 in accordance with the control method of the first embodiment in such a manner as to ensure maximum advantage of the performance of the lift device 14. Further, an operator requirement to accelerate the lift device 14 is acknowledged accurately, since such acknowledgement needs detection of the non-traveling operation and detection of the manipulated state of the lift raising acceleration switch 38. Also, through manipulation of the lift raising acceleration switch 38, the upper limit of the speed of the engine 11 can be selected between the value corresponding to the traveling operation and the value corresponding to the non-traveling operation.

(1-4) The first controller 1 sets the second engine speed upper limit if it is determined that the second loading actuator (the tilt device 15), an additional loading actuator to the first loading actuator (the lift device 14), is in a non-operated state. That is, the second engine speed upper limit is set if solely the lift device 14 is being operated. This ensures maximum advantage of the performance of the lift device 14. Further, under the second engine speed upper limit, the first controller 1 prohibits operation of the second loading actuator (the tilt device 15) while permitting operation of the lift device 14. In other words, the second loading actuator (the tilt device 15) is permitted to operate only under the first engine speed upper limit. This prevents the second loading actuator (the tilt device 15) from operating at a speed exceeding a normal level.

(1-5) The first controller 1 easily detects the non-traveling operation by detecting that the direction lever 25 is set at the neutral position through the direction lever sensor 39. The non-traveling operation is detected easily also by detection of a depressed state of the inching pedal 30 through the inching pedal sensor 40.

(1-6) The second engine speed upper limit is not set by the first controller 1 if the weight of the carried object is greater than the threshold value and may destabilize the body of the forklift 10. This prevents the operational speed of the loading actuators (the lift device 14 and the tilt device 15), or the second mechanisms, from increasing when the body of the forklift 10 is unstable. Particularly, the operational speed of the lift device 14 is prevented from increasing in the unstable state of the forklift 10. Accordingly, when the lift device 14 is operated with the forklift 10 in the non-traveling operation, stable lift operation is automatically ensured.

Although the first embodiment of the present invention has been described so far, the present invention is not restricted to this embodiment. The present invention can be modified in different forms without departing from the scope of the appended claims. For example, the present invention may be embodied in the following modifications.

(1) Although the industrial vehicle is embodied as the forklift 10 in the first embodiment, the present invention is not restricted to this. The present invention may be applied to an industrial vehicle having a crane or a shovel as an attachment, other than the lift device.

(2) In the first embodiment, each of the lift device 14 and the tilt device 15 serves as the second mechanism. However, any other mechanism actuated by the hydraulic fluid supplied from the hydraulic pump 22 may function as the second mechanism. Such mechanism may include an alternator (a power generator) or a power steering device.

(3) In the first embodiment, the upper limit of the engine speed is set between the two levels (the first engine speed upper level and the second engine speed upper level). However, the present invention is not restricted to this. For example, the second engine speed upper limit may include a plurality of sublevels. Alternatively, the second engine speed upper limit may be continuously variable.

(4) In the first embodiment, the upper limit of the speed of the engine 11 is set in accordance with detection of an operated state of the lift lever 26 or a manipulated state of the lift raising acceleration switch 38. However, the present invention is not restricted to this. For example, the second engine speed upper limit may be set if the non-traveling operation is detected, regardless of the detection of the operated state of the lift lever 26 or the manipulated state of the lift raising acceleration switch 38.

(5) In the first embodiment, the tilt device 15 functions as the second loading actuator, which is provided in addition to the first loading actuator (the lift device 14). However, the second actuator may be any other attachment device other than the tilt device 15, such as a fork shift device that moves a fork horizontally or a roll clamp device that clamps a rolled object.

Figure 6:
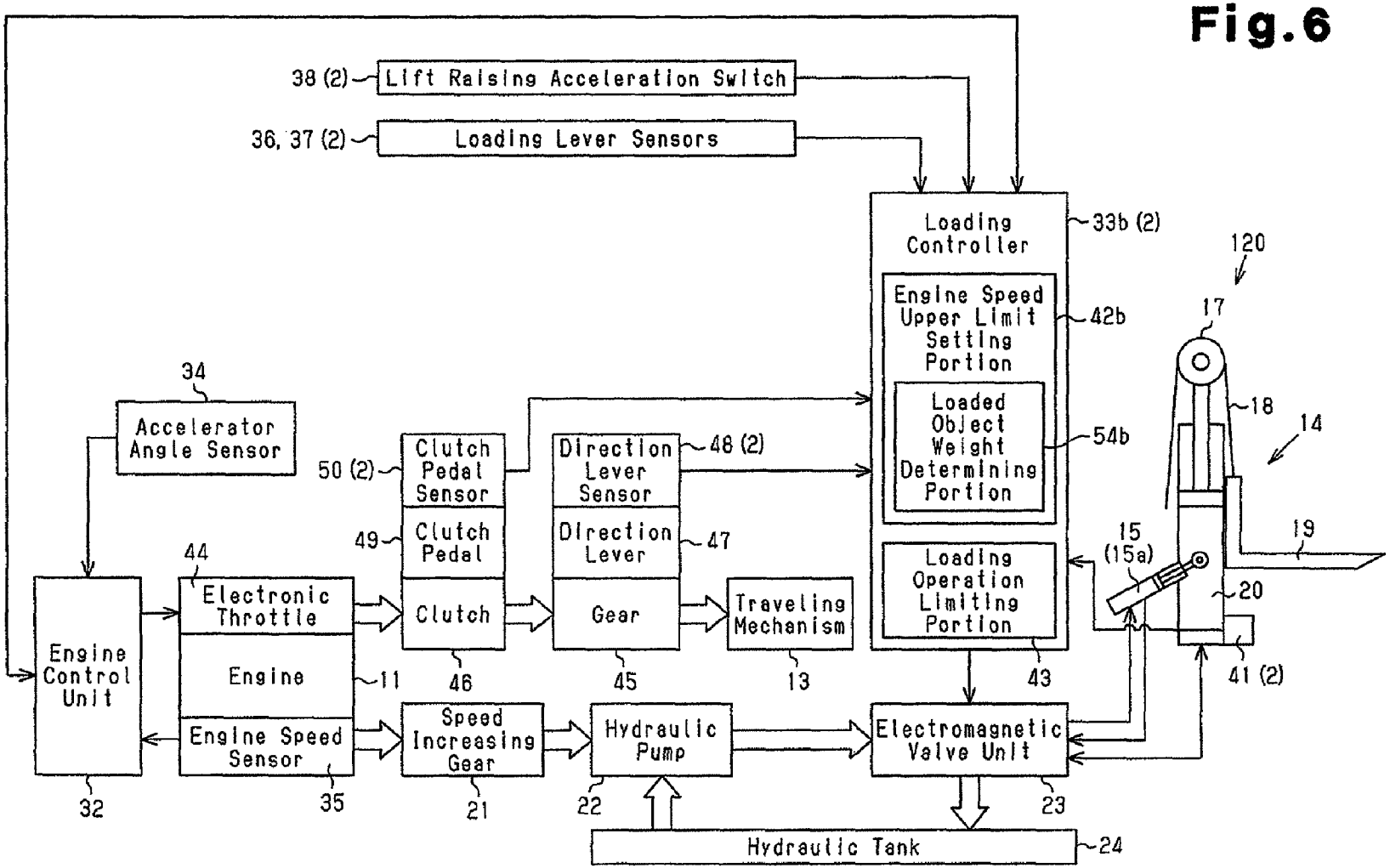
FIG. 6 is a diagram representing the configuration of a controller according to a second embodiment of the present invention, including a portion of an industrial vehicle.

A second embodiment of the present invention will hereafter be explained. FIG. 6 is a diagram representing a second controller 2 according to the second embodiment, including a portion of a forklift 120.

In the second embodiment, as illustrated in FIG. 6, the forklift 120 includes the engine 11, the traveling mechanism 13, a speed increasing gear 21, the hydraulic pump 22, the electromagnetic valve unit 23, the hydraulic tank 24, the lift device 14, the tilt device 15, and the engine control unit 32, like the corresponding parts of the forklift 10 of the first embodiment. The forklift 120 further includes a clutch mechanism 46, unlike the torque-converter type forklift 10 of the first embodiment. The clutch mechanism 46 selectively connects and disconnects the traveling mechanism 13, which is driven by the engine 11, with respect to the engine 11 through a gear 45.

The gear 45, which is a transmission mechanism, is operated in a switching manner by a non-illustrated operator of the forklift 120 through a direction lever 47. The direction lever 47 is formed as an operating portion that can be switched among a proceed position, a reverse position, and a neutral position. When the direction lever 47 is held at the proceed position, the forklift 120 of the second embodiment is caused to proceed. When the direction lever 47 is in the reverse position, the forklift 120 is caused to reverse. More specifically, the clutch mechanism 46 is switched through depression of a clutch pedal 49 by the operator of the forklift 120. In other words, by depressing the clutch pedal 49, the engine 11 is disengaged from the traveling mechanism 13 through the gear 45.

The second controller 2 has a traveling operation detecting portion, the second loading controller 33*b*, the loading lever sensors (the lift lever sensor 36 and the tilt lever sensor 37) like the corresponding components of the first embodiment, the lift raising acceleration switch 38, and the weight sensor 41. The lift raising acceleration switch 38 and the weight sensor 41 are configured identically to the corresponding components of the first embodiment.

Like the first embodiment, the traveling operation detecting portion of the second embodiment detects traveling operation and non-traveling operation of the forklift 120. The traveling operation corresponds to a state in which the operator operates the forklift 120 with an intention of driving the forklift 10, and the non-traveling operation corresponds to a state in which the operator operates the forklift 120 without an intention of driving the forklift 120. In the second embodiment, the traveling operation detecting portion is formed by a direction lever sensor 48 and a clutch pedal sensor 50.

Like the first embodiment, the direction lever sensor 48 forms a lever position detecting portion that detects the position of the direction lever 47 (a proceed position or a reverse position or a neutral position). The direction lever sensor 48 is connected to a second loading controller 33*b*. The direction lever sensor 48 generates a position detection signal and sends the signal to the second loading controller 33*b*.

The clutch pedal sensor 50 forms a clutch pedal depression detecting portion that detects an operated (depressed) state of the clutch pedal 49. The clutch pedal sensor 50 is connected to the second loading controller 33*b*. The clutch pedal sensor 50 generates a detection signal and sends the signal to the second loading controller 33*b*.

Like the first loading controller 33*a* of the first embodiment, the second loading controller 33*b* includes an upper limit setting portion (a maximum engine speed setting portion) 42*b* and a loading operation limiting portion (a loading operation limiter) 43.

As in the first embodiment, there are two engine speed upper limits set by the upper limit setting portion 42*b* as an upper limit of the speed of the engine 11 (a maximum engine speed), which defines an upper limit of an acceptable speed range of the engine 11. In this manner, depending on whether the state detected by the traveling operation detecting portion (48, 50) corresponds to the traveling operation or the non-traveling operation, two different values can be set as the engine speed upper limit. In other words, a first engine speed upper limit and a second engine speed upper limit are selectively set. The first engine speed upper limit is defined as the upper limit of the speed of the engine 11 that is determined in accordance with the traveling performance of the forklift 120. The second engine speed upper limit is defined as the upper limit of the speed of the engine 11 that is determined in accordance with the performance of the lift device 14, regardless of the traveling performance of the forklift 120. The second engine speed upper limit is higher than the first engine speed upper limit.

The upper limit setting portion 42*b* determines that the forklift 120 is in the non-traveling operation, at least if the direction lever sensor 48 detects that the direction lever 47 is located at the neutral position or the clutch pedal sensor 50 detects that the clutch pedal 49 is being operated. If the non-traveling operation is detected by either the direction lever sensor 48 or the clutch pedal sensor 50 and the lift lever sensor 36 detects that the lift lever 26 (not shown in FIG. 6) is being operated (if condition 3 is satisfied), the upper limit setting portion 42*b* is permitted to set the second engine speed upper limit. Further, if the non-traveling operation is detected and the lift raising acceleration switch 38 is in a manipulated state (if condition 4 is satisfied), the upper limit setting portion 42*b* is permitted to set the second engine speed upper limit. That is, if at least one of conditions 3, 4 is satisfied and the tilt lever sensor 37 detects that the tilt lever 27 (not shown in FIG. 6) is in a non-operated state, the upper limit setting portion 42*b* is permitted to set the second engine speed upper limit.

The loading operation limiting portion 43 of the second loading controller 33*b* is configured identically to the corresponding component of the first embodiment. Further, the upper limit setting portion 42*b* includes a weight determining portion 54*b*, like the first embodiment. If the weight of a carried object detected by the weight sensor 41 is smaller than or equal to a predetermined threshold value, the upper limit setting portion 42*b* sets the second engine speed upper limit.

The second controller 2 has the following advantages.

(2-1) Like the first controller 1, the second controller 2 controls operation of the engine 11 in different manners depending on the operational state of the forklift 120. Specifically, if the forklift 120 is in the traveling operation in which the engine 11 is driving the traveling mechanism 13, the second controller 2 controls the operation of the engine 11 in a certain manner. If the forklift 120 is in the non-traveling operation in which the traveling mechanism 13 is disconnected from the engine 11 and the engine 11 is driving the loading actuators (the lift device 14 and the tilt device 15) as the second mechanisms, the operation of the engine 11 is controlled in a different manner. In this manner, maximum advantage of the performance of the engine 11 is ensured and the operational efficiency of the forklift 120 is improved.

(2-2) In the forklift 120, the clutch mechanism 46 selectively connects or disconnects the traveling mechanism 13 with respect to the engine 11. The second controller 2 easily detects the non-traveling operation by detecting a depressed state of the clutch pedal 49 through the clutch pedal sensor 50.

Although the second embodiment of the present invention has been described so far, the invention is not restricted to this embodiment. The present invention may be modified in different forms without departing from the scope of the claims.

Figure 7:
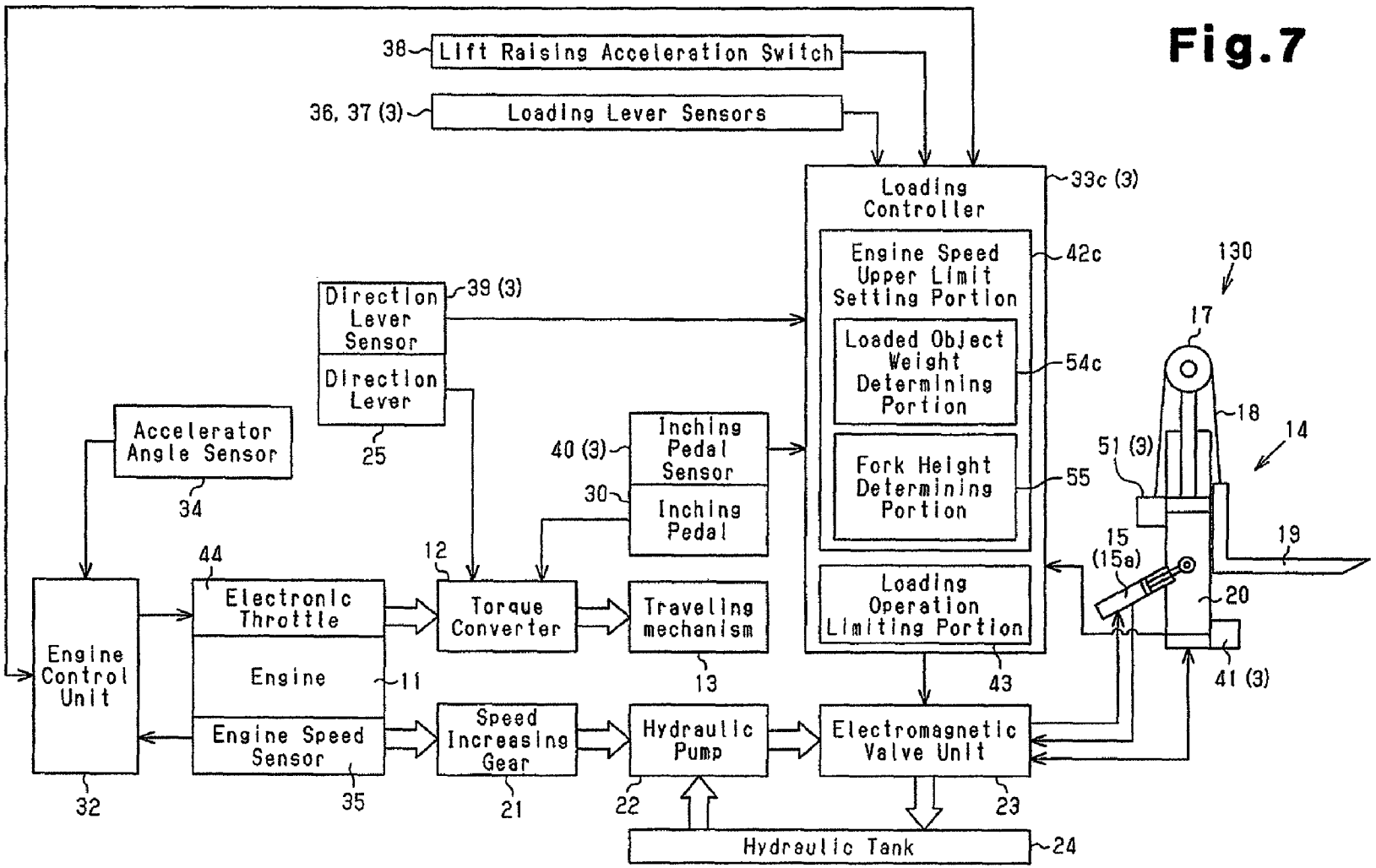
FIG. 7 is a diagram representing the configuration of a controller according to a third embodiment of the present invention, including a portion of an industrial vehicle.

A third embodiment of the present invention will hereafter be explained. FIG. 7 is a diagram representing a third controller 3 of the third embodiment, including a portion of a forklift 130.

The forklift 130 of the third embodiment is configured identical to the forklift 10 of the first embodiment. Contrastingly the third controller 3 includes a fork height sensor 51, unlike the first controller 1. Thus, operation of an upper limit setting portion 42*c* of a third loading controller 33*c* by the third controller 3 is performed in correspondence also with an output of the fork height sensor 51.

The fork height sensor 51 is formed as a fork height detecting portion that detects the height of the fork 19 that corresponds to the height of the object carried by the forklift 130. The fork height sensor 51 is secured to the outer masts 16 at a predetermined height. The fork height sensor 51 is formed by, for example, a limit switch. If the height of the fork 19 is less than a predetermined level, the fork height sensor 51 is turned off. If the height of the fork 19 is not less than the predetermined level, the fork height sensor 51 is turned on. In other words, if the fork height sensor 51 is turned on, it is indicated that the height of the fork 19 exceeds a threshold value. The fork height sensor 51 is connected to the third loading controller 33*c*. The fork height sensor 51 generates a detection signal and sends the signal to the third loading controller 33*c*.

The third loading controller 33*c* is configured identically to the first loading controller 33*a* of the first embodiment. The third loading controller 33*c* includes an upper limit setting portion (a maximum engine speed setting portion) 42*c* and the loading operation limiting portion 43 similar to the corresponding component of the first embodiment.

The upper limit setting portion 42*c* sets a second engine speed upper limit if a weight determining portion 54*c* determines that the weight of a carried object detected by a weight sensor 41 is smaller than or equal to the predetermined threshold value. Further, unlike the upper limit setting portion 42*a* of the first embodiment, such operation of the upper limit setting portion 42*c* involves detection results of the fork height sensor 51. Specifically, like the first embodiment, the upper limit setting portion 42*c* sets the second engine speed upper limit if the non-traveling operation and a prescribed operation of the lift lever 26 or the lift raising acceleration switch 38 have been detected and the tilt lever 27 (not shown in FIG. 7) is in a non-operated state.

The upper limit setting portion 42*c* includes a height determining portion 55 that determines whether the height of the fork 19, which is detected by the fork height sensor 51, is less than the predetermined level. If the height of the fork 19 detected by the fork height sensor 51 is not less than the threshold value under the second engine speed upper limit, the upper limit setting portion 42*c* immediately changes the set value to a first engine speed upper limit.

The third controller 3 has the following advantages.

(3-1) Like the first controller 1, the third controller 3 controls operation of the engine 11 in different manners depending on the operational state of the forklift 130. Specifically, if the forklift 130 is in the traveling operation in which the engine 11 is driving the traveling mechanism 13, the third controller 3 controls the operation of the engine 11 in a certain manner. If the forklift 130 is in the non-traveling operation in which the traveling mechanism 13 is disconnected from the engine 11 and the engine 11 is driving the loading actuators (the lift device 14 and the tilt device 15) as the second mechanisms, the operation of the engine 11 is controlled in a different manner. In this manner, maximum advantage of the performance of the engine 11 is ensured and the operational efficiency of the forklift 130 is improved.

(3-2) If the height of the fork 19 exceeds the threshold value while the lift device 14 is being raised at an increased speed under the second engine speed upper limit corresponding to the non-traveling operation, the third controller 3 switches the set value to the first engine speed upper limit corresponding to the non-traveling operation. The lift speed of the lift device 14 is thus decreased, suppressing an impact caused when lifting of the lift device 14 comes to an end.

(3-3) If the height of the fork 19 exceeds the threshold value and the body of the forklift 130 can become unstable, the third controller 3 cancels the second engine speed upper limit corresponding to the non-traveling operation (switches to the first engine speed upper limit). This prevents the operational speed of the second loading actuator (the tilt device 15), the additional loading actuator to the first loading actuator (the lift device 14), from being increased when the body of the forklift 130 is unstable.

Although the third embodiment of the present invention has been described so far, the invention is not restricted to this. The present invention may be modified in different manners without departing from the scope of the claims.

Figure 8:
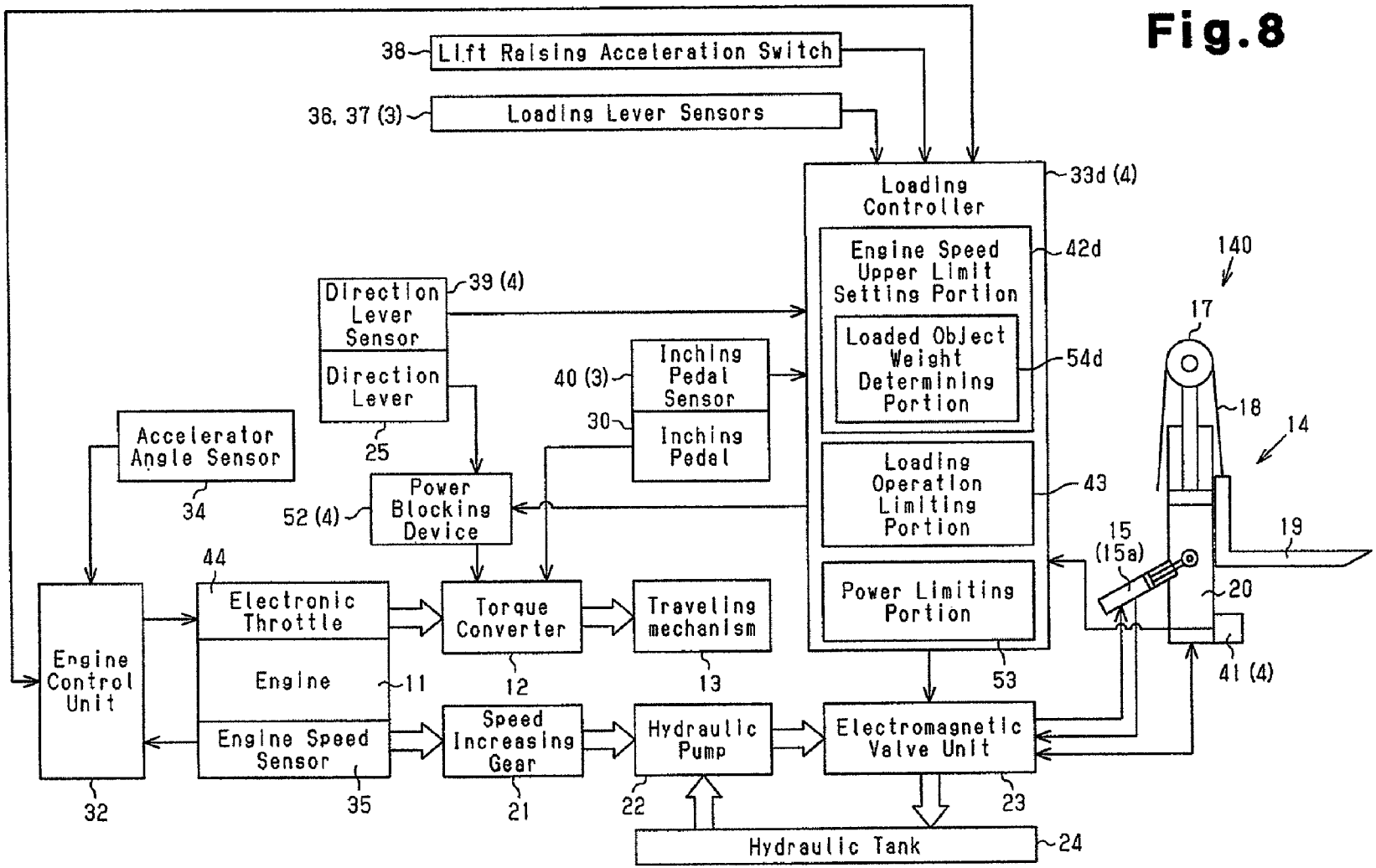
FIG. 8 is a diagram representing the configuration of a controller according to a fourth embodiment of the present invention, including a portion of an industrial vehicle.

A fourth embodiment of the present invention will hereafter be described. FIG. 8 is a diagram representing a fourth controller 4 of the fourth embodiment, including a portion of a forklift 140.

The forklift 140 of the fourth embodiment is configured identically to the forklift 10 of the first embodiment. Contrastingly, the fourth controller 4 includes a power blocking device 52, unlike the first controller 1. Further, a portion of a fourth loading controller 33*d* of the fourth controller 4 is configured differently from a corresponding part of the first controller 1.

The power blocking device 52 is formed as a circuit that blocks sending of a drive signal from the direction lever 25 to the torque converter 12 in correspondence with a signal generated by the fourth loading controller 33*d*. In other words, the power blocking device 52 functions as a power blocking portion that blocks power transmission from the engine 11 to the traveling mechanism 13.

The fourth loading controller 33*d* includes an upper limit setting portion 42*d*, the loading operation limiting portion 43, and a power limiting portion 53. The upper limit setting portion 42*d* of the fourth loading controller 33*d* is configured identically to the upper limit setting portion 42*a* of the first loading controller 33*a*. The loading operation limiting portion 43 of the fourth loading controller 33*d* is configured identically to the corresponding component of the first loading controller 33*a*. The upper limit setting portion 42*d* has a weight determining portion 54*d* configured identically to the weight determining portion 54*a*. That is, the difference between the fourth loading controller 33*d* and the first loading controller 33*a* is that the fourth loading controller 33*d* has the power limiting portion 53.

If the upper limit setting portion 42*d* sets a second engine speed upper limit, the power limiting portion 53 sends a blocking signal to the power blocking device 52. In accordance with the blocking signal, operation of the power blocking device 52 is controlled in such a manner as to block the power transmission from the engine 11 to the traveling mechanism 13. That is, in response to the blocking signal, the power blocking device 52 suspends sending of the drive signal from the direction lever 25 to the torque converter 12 until inputting of the blocking signal by the power limiting portion 53 is stopped. More specifically, if the upper limit setting portion 42*d* sets a first engine speed upper limit when the blocking signal is sent by the power limiting portion 53, the power limiting portion 53 sends a canceling signal to the power blocking device 52. In accordance with the canceling signal, the power blocking device 52 operates to stop blocking of the power transmission from the engine 11 to the traveling mechanism 13. In other words, in response to the canceling signal, the power blocking device 52 permits sending of the drive signal from the direction lever 25 to the torque converter 12.

The fourth controller 4 has the following advantages.

(4-1) Like the first controller 1, the fourth controller 4 controls operation of the engine 11 in different manners depending on the operational state of the forklift 140. Specifically, if the forklift 140 is in the traveling operation in which the engine 11 is driving the traveling mechanism 13, the fourth controller 4 controls the operation of the engine 11 in a certain manner. If the forklift 140 is in the non-traveling operation in which the traveling mechanism 13 is disconnected from the engine 11 and the engine 11 is driving the loading actuators (the lift device 14 and the tilt device 15) as the second mechanisms, the operation of the engine 11 is controlled in a different manner. In this manner, maximum advantage of the performance of the engine 11 is ensured and the operational efficiency of the forklift 140 is improved.

(4-2) Even if any operation is erroneously performed to switch from the non-traveling operation to the traveling operation under the second engine speed upper limit, the fourth controller 4 maintains the forklift 140 in the state in which the power transmission from the engine 11 to the traveling mechanism 13 is blocked. This reliably prevents the forklift 140 from, for example, starting to travel rapidly under the second engine speed upper limit.

Although the fourth embodiment of the present invention has been described so far, the present invention is not restricted to the invention. The invention may be modified in various manners without departing from the scope of the claims.

Although the multiple embodiments have been described herein, it will be clear to those skilled in the art that the present invention may be embodied in different specific forms without departing from the spirit of the invention. The invention is not to be limited to the details given herein, but may be modified within the scope and equivalence of the appended claims.

The invention claimed is:

1. An industrial vehicle driven by an engine, the industrial vehicle comprising:

a lift device, or a loading actuator, that operates to selectively raise and lower an object carried by the industrial vehicle;

a lift operating portion by which the lift device is operated, the lift operating portion is driven by the engine;

a lift operation detecting portion that detects whether the lift operating portion has been operated;

a traveling mechanism that is driven by the engine causing the industrial vehicle to travel;

a direction lever that is switched among a proceed position at which the industrial vehicle is caused to proceed, a reverse position at which the industrial vehicle is caused to reverse, and a neutral position between the proceed position and the reverse position;

a direction lever position detecting portion that detects the position of the direction lever;

a torque converter that transmits power from the engine to the traveling mechanism;

an inching pedal by which the torque converter is operated to adjust the power transmission;

an inching pedal detecting portion that detects an operation of the inching pedal, the operation of the inching pedal indicating a non-traveling operation; and an upper limit setting portion that selectively sets, as an upper limit of an acceptable speed range of the engine, a first engine speed upper limit and a second engine speed upper limit, the second engine speed upper limit being greater than the first engine speed upper limit, wherein the upper limit setting portion sets the second engine speed upper limit when the lift operation detecting portion has detected operation of the lift operating portion, and the direction lever position detecting portion has detected that the direction lever has been switched to the neutral position, or the inching pedal detecting portion detects the operation of the inching pedal, and wherein the upper limit setting portion sets the first engine speed upper limit in a case that the direction lever has not been switched to the neutral position and the inching pedal has not been operated.

2. The industrial vehicle according to claim 1, further comprising a lift acceleration switch by which an operational mode of the lift device is switched to an acceleration mode, wherein the upper limit setting portion sets the second engine speed upper limit if an additional condition that the lift acceleration switch has been manipulated is satisfied.

3. The industrial vehicle according to claim 1, wherein the lift device is a first loading actuator, the industrial vehicle including a second loading actuator in addition to the lift device, and a loading operating portion by which the second loading actuator is operated, wherein the industrial vehicle further includes a loading operation detecting portion that detects whether the loading operating portion has been operated, and wherein the upper limit setting portion sets the second engine speed upper limit if an additional condition that the loading operation detecting portion has not detected the operation of the loading operating portion is satisfied.

4. The industrial vehicle according to claim 3, further comprising a loading operation limiting portion, wherein, if the loading operating portion is operated under the second engine speed upper limit, the loading operation limiting portion limits operation of the second loading actuator based on operation of the loading operating portion.

5. The industrial vehicle according to claim 1, further including a power blocking portion and a power limiting portion, the power blocking portion blocking power transmission from the engine to the traveling mechanism, the power limiting portion controlling operation of the power blocking portion under the second engine upper limit in such a manner as to block the power transmission from the engine to the traveling mechanism.

6. The industrial vehicle according to claim 1, further comprising a weight detector that detects the weight of the object carried by the industrial vehicle, wherein the upper limit setting portion sets the second engine speed upper limit if an additional condition that the weight of the object that has been detected by the weight detector is smaller than or equal to a predetermined threshold value is satisfied.

7. The industrial vehicle according to claim 1, further comprising a height detecting portion that detects the height of the object carried by the industrial vehicle, wherein the upper limit setting portion sets the first engine speed upper limit if an additional condition that the height that has been detected by the height detecting portion is greater than or equal to a predetermined threshold value is satisfied.

8. An industrial vehicle driven by an engine, the industrial vehicle comprising:

a lift device, or a loading actuator, that operates to selectively raise and lower an object carried by the industrial vehicle;

a lift operating portion by which the lift device is operated, the lift operating portion is driven by the engine;

a lift operation detecting portion that detects whether the lift operating portion has been operated;

a traveling mechanism that is driven by the engine causing the industrial vehicle to travel;

a direction lever that is switched among a proceed position at which the industrial vehicle is caused to proceed, a reverse position at which the industrial vehicle is caused to reverse, and a neutral position between the proceed position and the reverse position;

a direction lever position detecting portion that detects the position of the direction lever;

a torque converter that transmits power from the engine to the traveling mechanism;

a clutch mechanism that stops the power transmission from the engine to the traveling mechanism;

a clutch pedal by which the clutch mechanism is operated;

a clutch pedal depression detecting portion that detects depression of the clutch pedal; and an upper limit setting portion that selectively sets, as an upper limit of an acceptable speed range of the engine, a first engine speed upper limit and a second engine speed upper limit, the second engine speed upper limit being greater than the first engine speed upper limit, wherein the upper limit setting portion sets the second engine speed upper limit when the lift operation detecting portion has detected operation of the lift operating portion, and the direction lever position detecting portion has detected that the direction lever has been switched to the neutral position, or the clutch pedal depression detecting portion detects the depression of the clutch pedal, and wherein the upper limit setting portion sets the first engine speed upper limit in a case that the direction lever has not been switched to the neutral position and the clutch pedal has not been operated.

9. A method for controlling an industrial vehicle driven by an engine, the industrial vehicle including a lift device, or a loading actuator, that operates to selectively raise and lower an object carried by the industrial vehicle; a lift operating portion by which the lift device is operated, the lift operating portion is driven by the engine; a lift operation detecting portion that detects whether the lift operating portion has been operated; a traveling mechanism that is driven by the engine causing the industrial vehicle to travel; a direction lever that is switched among a proceed position at which the industrial vehicle is caused to proceed, a reverse position at which the industrial vehicle is caused to reverse, and a neutral position between the proceed position and the reverse position; a torque converter that transmits power from the engine to the traveling mechanism; an inching pedal by which the torque converter is operated to adjust the power transmission, the method comprising:

setting a first engine speed upper limit in a case that the direction lever has not been switched to the neutral position and the inching pedal has not been operated; and setting a second engine speed upper limit, which is greater than the first engine speed upper limit, in response to detecting an operation of the lift operation portion and in response to detecting that the direction lever has been switched to the neutral position or detecting an operation of the inching pedal.

10. An industrial vehicle driven by an engine, the industrial vehicle comprising:

a lift device that operates to selectively raise and lower an object carried by the industrial vehicle;

a lift operating portion by which the lift device is operated, the lift operating portion is driven by the engine;

a lift operation detecting portion that detects whether the lift operating portion has been operated;

a tilt device that operates to selectively tilt an object carried by the industrial vehicle in a forward direction and a rearward direction;

a tilt operating portion by which the tilt device is operated, the tilt operating portion is driven by the engine;

a tilt operation detecting portion that detects whether the tilt operating portion has been operated;

a traveling mechanism that is driven by the engine causing the industrial vehicle to travel;

a direction lever that is switched among a proceed position at which the industrial vehicle is caused to proceed, a reverse position at which the industrial vehicle is caused to reverse, and a neutral position between the proceed position and the reverse position;

a direction lever position detecting portion that detects the position of the direction lever;

a torque converter that transmits power from the engine to the traveling mechanism;

an inching pedal by which the torque converter is operated to adjust the power transmission;

an inching pedal detecting portion that detects an operation of the inching pedal, the operation of the inching pedal indicating a non-traveling operation; and an upper limit setting portion that selectively sets, as an upper limit of an acceptable speed range of the engine, a first engine speed upper limit and a second engine speed upper limit, the second engine speed upper limit being greater than the first engine speed upper limit, wherein the upper limit setting portion sets the second engine speed upper limit when (1) the lift operation detecting portion has detected operation of the lift operating portion and the tilt operation detecting portion has not detected operation of the tilt operating portion, and (2) the direction lever position detecting portion has detected that the direction lever has been switched to the neutral position or the inching pedal detecting portion detects the operation of the inching pedal, and wherein the upper limit setting portion sets the first engine speed upper limit in a case that (1) the direction lever has not been switched to the neutral position and the inching pedal has not been operated, or (2) the tilt operation detecting portion has detected operation of the tilt operation portion.

* * * * *